US010486438B2

(12) United States Patent
Paul et al.

(10) Patent No.: US 10,486,438 B2
(45) **Date of Patent: *Nov. 26, 2019**

(54) METHOD FOR PRODUCING PRINTED PRODUCTS AND PRINTING MACHINE FOR IMPLEMENTING THE METHOD

(71) Applicant: HEIDELBERGER DRUCKMASCHINEN AG, Heidelberg (DE)

(72) Inventors: Thomas Paul, Heidelberg (DE); Peter Hachmann, Weinheim-Hohensachsen (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

This patent is subject to a terminal disclaimer.

(21) Appl. No.: 15/716,630

(22) Filed: Sep. 27, 2017

(65) Prior Publication Data

US 2018/0134047 A1 May 17, 2018

(30) Foreign Application Priority Data

Sep. 27, 2016 (DE) ..... 10 2016 218 532

(51) Int. Cl.
*B41J 11/00* (2006.01)
*B41M 7/00* (2006.01)
*B41M 5/00* (2006.01)

(52) U.S. Cl.
CPC ..... *B41J 11/002* (2013.01); *B41J 11/0015* (2013.01); *B41M 5/0011* (2013.01); *B41M 7/009* (2013.01); *B41M 7/0054* (2013.01)

(58) Field of Classification Search
CPC ..... B41J 11/002; B41J 11/0015
See application file for complete search history.

(56) References Cited

U.S. PATENT DOCUMENTS

2010/0053236 A1 3/2010 Ooishi et al.
2012/0086762 A1 4/2012 Noguchi et al.
2016/0052317 A1 2/2016 Kyoso
2017/0341419 A1* 11/2017 Hachmann ..... B41M 5/0017

FOREIGN PATENT DOCUMENTS

JP 2014200988 A 10/2014

* cited by examiner

*Primary Examiner* — Jason S Uhlenhake
(74) *Attorney, Agent, or Firm* — Laurence A. Greenberg; Werner H. Stemer; Ralph E. Locher

(57) ABSTRACT

A method for producing a printed product includes coating a preferably paper or cardboard substrate with a precoat or supplying a substrate that has been coated with a precoat, in which the precoat contains at least one acid, applying a water-based ink to image areas on the coated substrate by using at least one ink print head, and drying the printed substrate and/or the ink, preferably using IR radiation and/or heated air. The precoat includes a photobase generator or a photobase generator is applied at least locally to non-image areas on the substrate, the substrate is irradiated at least locally in non-image areas, preferably using UV radiation, to locally generate a base, and the printed substrate is varnished with a water-based varnish.

10 Claims, 2 Drawing Sheets

METHOD FOR PRODUCING PRINTED PRODUCTS AND PRINTING MACHINE FOR IMPLEMENTING THE METHOD

CROSS-REFERENCE TO RELATED APPLICATION

This application claims the benefit, under 35 U.S.C. § 119, of German Patent Application DE 10 2016 218 532.2, filed Sep. 27, 2016; the prior application is herewith incorporated by reference in its entirety.

THE NAMES OF THE PARTIES TO A JOINT RESEARCH AGREEMENT

This invention was made pursuant to a joint research agreement between Heidelberger Druckmaschinen AG and Fujifilm Corporation.

BACKGROUND OF THE INVENTION

Field of the Invention

The present invention relates to a method for producing printed products, which includes coating a substrate with a precoat or supplying a substrate that has been coated with a precoat, the precoat in each case containing at least one acid, applying a water-based ink to image areas on the coated substrate by using at least one ink print head, and drying the printed substrate and/or the ink. The present invention further relates to a printing machine for implementing the method including a substrate feeder, at least one ink print head, and a drier.

The technical field of the invention is the graphic arts industry, in particular the field of inkjet printing. In the known drop-on-demand ink printing processes (DOD processes), a printed image is created on a printing material by a print head that generates tiny ink drops in accordance with the image to be printed and transfers them to the printing material in a contact-free way. The printing substrate may be made of paper, cardboard, or plastic, and it may be a sheet or a web. In so-called water-based ink printing, the liquid ink contains water as a way to carry the colorant, in particular a pigment.

U.S. Publication US 2010/0053236 A1 discloses an ink printing process wherein a water-based ink is applied to a substrate the entire surface of which has previously been provided with a so-called precoat. Then the ink is dried. The precoat contains an acid to ensure that the pigments of the ink agglomerate and the ink drop, i.e. the printed dot on the substrate, maintains its sharp edges and does not spread. The document does not disclose any information on finishing the printed product, in particular varnishing it.

Experiments have shown that the acidic precoat may cause problems in the finishing process, in particular when the printed product is varnished. Varnished areas of the printed product to which ink has previously been applied and unprinted varnished areas may exhibit undesirable gloss effect differences. Such problems, in particular, occur when water-based varnish is used. A potential solution is to use a different varnishing system, e.g. UV varnish. The present invention, however, chooses a different path.

SUMMARY OF THE INVENTION

It is accordingly an object of the invention to provide a method for producing printed products and a printing machine for implementing the method, which improve and overcome the hereinafore-mentioned disadvantages of the heretofore-known methods and machines of this general type and which allow the production of high-quality printed products, in particular printed products that are created in an ink printing process and are subsequently finished, e.g. varnished printed products that are free from undesired gloss effect differences.

With the foregoing and other objects in view there is provided, in accordance with the invention, a method for producing a printed product, which comprises the steps of coating a substrate with a precoat or supplying a substrate that has been coated with a precoat, the precoat in both cases containing at least one acid, applying a water-based ink to image areas on the coated substrate by using at least one ink print head, drying the printed substrate and/or the ink, providing the precoat as a photobase generator or applying a photobase generator at least locally to non-image areas on the substrate, irradiating the substrate at least locally in non-image locations, locally creating a base, and varnishing the printed substrate with a water-based varnish.

The method of the invention advantageously allows the production of high-quality printed products, in particular products that are produced in an ink printing process and are subsequently finished, e.g. varnished, without undesirable gloss variation.

A photobase generator is frequently abbreviated as PBG. Irradiation of the generator, in particular UV irradiation, frees a base that neutralizes the acid at least in the non-printed areas, i.e. the non-image areas.

The precoat may be referred to as a pre-treatment (of the substrate). The precoat preferably includes at least one organic acid and/or phosphoric acid.

Another preferred development of the invention is distinguished in that the precoat already contains the photobase generator when it is supplied or that the precoat and the photobase generator are supplied separately and mixed. The precoat may contain water as a solvent and the photobase generator may be added to the aqueous precoat. In this case, the precoat is applied to the substrate together with the generator. This advantageously eliminates the need for an additional application device for applying the generator.

A further preferred development of the invention is distinguished in that the photobase generator is selected from the following list of photobase generators including quaternary ammonium salts of organic acids such as phenylglyoxylic acid, oxo xanthan propionic acid; O-acyl oximes, amine-substituted ketones, in particular 2-methyl-1-[4-(methylthio)phenyl]-2-(4-morpholinyl)-1-propanone, quaternary ammonium salts of dithiocarbamate.

An added preferred development of the invention is distinguished in that the irradiation occurs in a UV wavelength range, in particular with radiation that is created by at least one LED, and/or in a wavelength range below 400 nanometers. The wavelength range is advantageous because photobase generators that are adapted to this range outside the optical spectrum and are absorbent in a corresponding way are colorless themselves and thus do not have any undesirable effect on the printed product. LEDs are advantageously selected because they may be adapted to the absorption of the generators. The LEDs may also be provided as a line or an array, allowing irradiation in a space-resolved way.

An additional preferred development of the invention is distinguished in that the irradiation occurs before the printing process, in particular immediately before the printing operation.

Another preferred development of the invention is distinguished in that the irradiation occurs before the drying process, in particular immediately before the drying process.

A further preferred development of the invention is distinguished in that the irradiation occurs before the varnishing process, in particular immediately before the varnishing operation. In accordance with a particularly preferred feature, the irradiation occurs after the drying process and before the varnishing process.

An added preferred development of the invention is distinguished in that the drying process is a thermal process, in particular by electromagnetic radiation, e.g. IR radiation, and/or by the application of heated air, e.g. hot air.

With the objects of the invention in view, there is also provided a printing machine for implementing one of the aforementioned methods, the printing machine comprising a substrate feeder, at least one ink print head, a dryer, an application device for a precoat, an emitter for creating a base in a photolytic way, and a varnishing unit. The emitter is preferably a UV emitter, in particular a UV LED emitter.

A preferred further development of the invention is distinguished by a mixer for mixing the precoat and the photobase generator. The mixer may be disposed upstream of the application device.

Other features which are considered as characteristic for the invention are set forth in the appended claims.

Although the invention is illustrated and described herein as embodied in a method for producing printed products and a printing machine for implementing the method, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
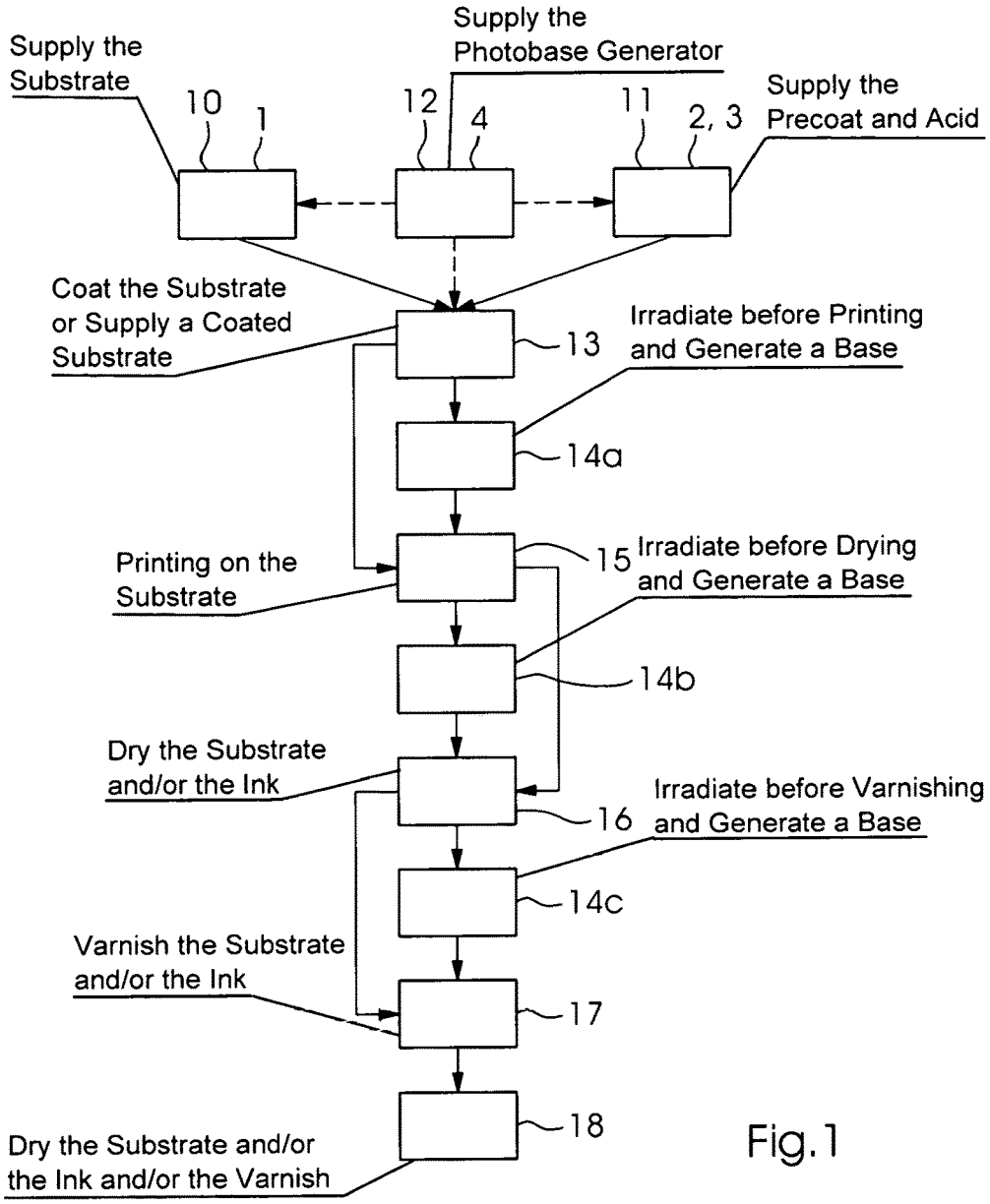
FIG. 1 is a flow chart of a preferred exemplary embodiment of a method of the invention.

Referring now in detail to the figures of the drawings, in which identical reference symbols identify mutually corresponding elements and merely repetitive symbols have partly been omitted for clarity, and first, particularly, to FIG. 1 thereof, there is seen a flow chart which represents a preferred embodiment of the method of the invention for producing a high-quality printed product, in particular a printed product that has been finished, i.e. varnished. The individual steps of the method will be listed and explained in more detail below. When reference is made to the printing machine of the invention for implementing the method or the components thereof used to carry out the steps, the reference symbols refer to FIG. 2.

Step 10 (supplying the substrate): the substrate 1, which is preferably a sheet or web of paper or cardboard, is supplied for further steps. The sheet may be supplied in a sheet-feeder 21 (substrate feeder). Alternatively, there may be a web feeder.

Step 11 (supplying the precoat containing an acid): a precoat 2 including at least one acid 3, i.e. an acid-containing precoat, is supplied for the further steps. The precoat may be supplied in an application device 26, e.g. by using a trough and a dipping roller.

Step 12 (supplying a photobase generator): a photobase generator 4 is supplied for the further steps. The photobase generator may be supplied in a reservoir inside or outside the printing machine 20. It may be connected to the aforementioned precoat trough by a generator supply line. The dashed arrows are intended to imply that the generator may either be added to the precoat 2 and/or may be applied to the substrate 1. In a preferred process, the generator is added to the precoat, e.g. the precoat contains a photobase generator and the two are jointly applied by using a common application device. The generator may be applied to the substrate before, during, or after the application of the precoat. The photobase generator is applied at least locally to non-image areas on the substrate (see step 15 for a definition of non-image areas).

Step 13 (coating the substrate or supplying a coated substrate): the supplied substrate 1 is preferably coated with the supplied precoat 2. The precoat is preferably applied as a liquid, in particular as an aqueous liquid. The application is preferably achieved by using an applicator roller (or a spraying device) of the application device 26, or alternatively by using a drop-on-demand device comparable to a print head. Alternatively, a substrate 1 that has previously been coated with a precoat 2 may be provided, that is to say that steps 10, 11 and 13 may be combined. In any case, a substrate including the precoat, preferably in the form of a coating on the substrate side to be printed on, is available for the subsequent steps. Optionally, the precoat and/or the substrate are dried, preferably in a drier 25*a*, in particular a thermal drier such as an IR drier and/or a hot-air drier.

Figure 3:
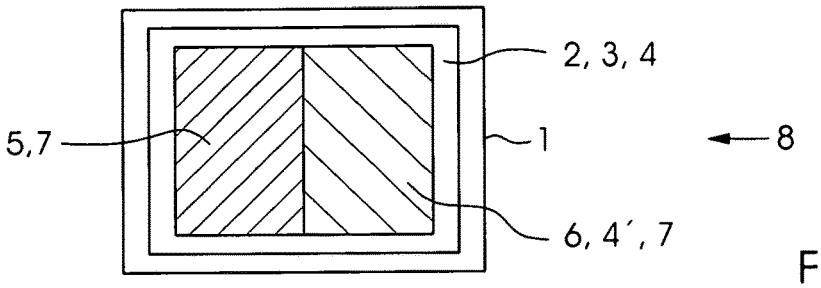
FIG. 3 is a plan view of a printed product that has been created in accordance with the invention.

Steps 14*a*, 14*b* and 14*c* (irradiating and generating a base): afterwards the substrate 1 is locally irradiated at least in non-image locations 6 shown in FIG. 3. Thus, a base 4' is generated by using the photobase generator 4 in a photochemical or photolytical process. Global irradiation, i.e. an irradiation of the entire surface, is possible, but not preferred. The base acts to neutralize the acid 3 in the precoat 2. This advantageously prevents non-neutralized acid from having any undesirable effects on the glossiness of a printed product 8. The irradiation is preferably achieved by using an emitter 27, in particular an emitter including LEDs or alternatively a blower 27', and its radiation or alternatively heated air 27". The irradiation may be implemented in accordance with step 14*a*, step 14*b*, or step 14*c*. In accordance with step 14*a*, the irradiation may occur before a printing operation (15) (see below), in particular immediately before the printing operation. In accordance with step 14*b*, the irradiation may occur before a drying operation 16 (see below), in particular immediately before the drying operation. In accordance with step 14*c*, the irradiation may occur before a varnishing operation, in particular immediately before the varnishing operation. In accordance with a particularly preferred aspect, the irradiation occurs after the drying operation 16 and before the varnishing operation 17. In addition, two or three irradiation steps are possible, i.e. in accordance with steps 14*a*, 14*b* and 14*c*. The irradiation preferably occurs in a UV wavelength range, in particular with radiation that is created by at least one LED 27', and/or in a wavelength range below 400 nanometers.

Step 15 (printing on the substrate): a water-based ink 23' is now applied to image areas 5 on the precoated substrate 2 by using at least one ink print head 23 (see FIG. 3). Image data are supplied to the print head for this purpose. Areas on the substrate that do not receive any ink are referred to as non-image areas. The precoat 2 is covered with ink in image areas 5. The precoat 2 is not covered by ink in non-image areas 6, i.e. the precoat (and any photobase generator 4 contained therein) is exposed.

Step 16 (drying the substrate and/or the ink): the printed substrate 2 and/or the ink 23' on the substrate are dried. The drying operation preferably takes place in a drier 25*b* and/or 25*c*, in particular a thermal drier such as an IR drier and/or a hot-air drier. In the drying process, water is evaporated from the ink and/or from the substrate and, if necessary, actively removed, e.g. by suction.

Step 17 (varnishing the substrate and/or the ink): the printed substrate 1 is now varnished with a water-based varnish 7. The application of varnish is preferably carried out in a varnishing unit 28, in particular using an applicator roller or a spraying device or, alternatively, a drop-on-demand device comparable to a print head. The varnish may be applied in accordance with a varnish image or across the entire surface. In accordance with a preferred process, at least the image areas are varnished.

Step 18 (drying the substrate and/or the ink and/or the varnish): the varnish 7 and/or the printed substrate 1 are now dried. The drying process preferably takes place in a drier 25*d*, in particular a thermal drier such as an IR drier and/or a hot-air drier. The dried printed products 8 may finally be delivered to a stack in a sheet delivery 24 and/or subjected to further processing steps such as cutting or folding. A web-shaped substrate may then be wound up or cut in a transverse direction and deposited.

Figure 2:
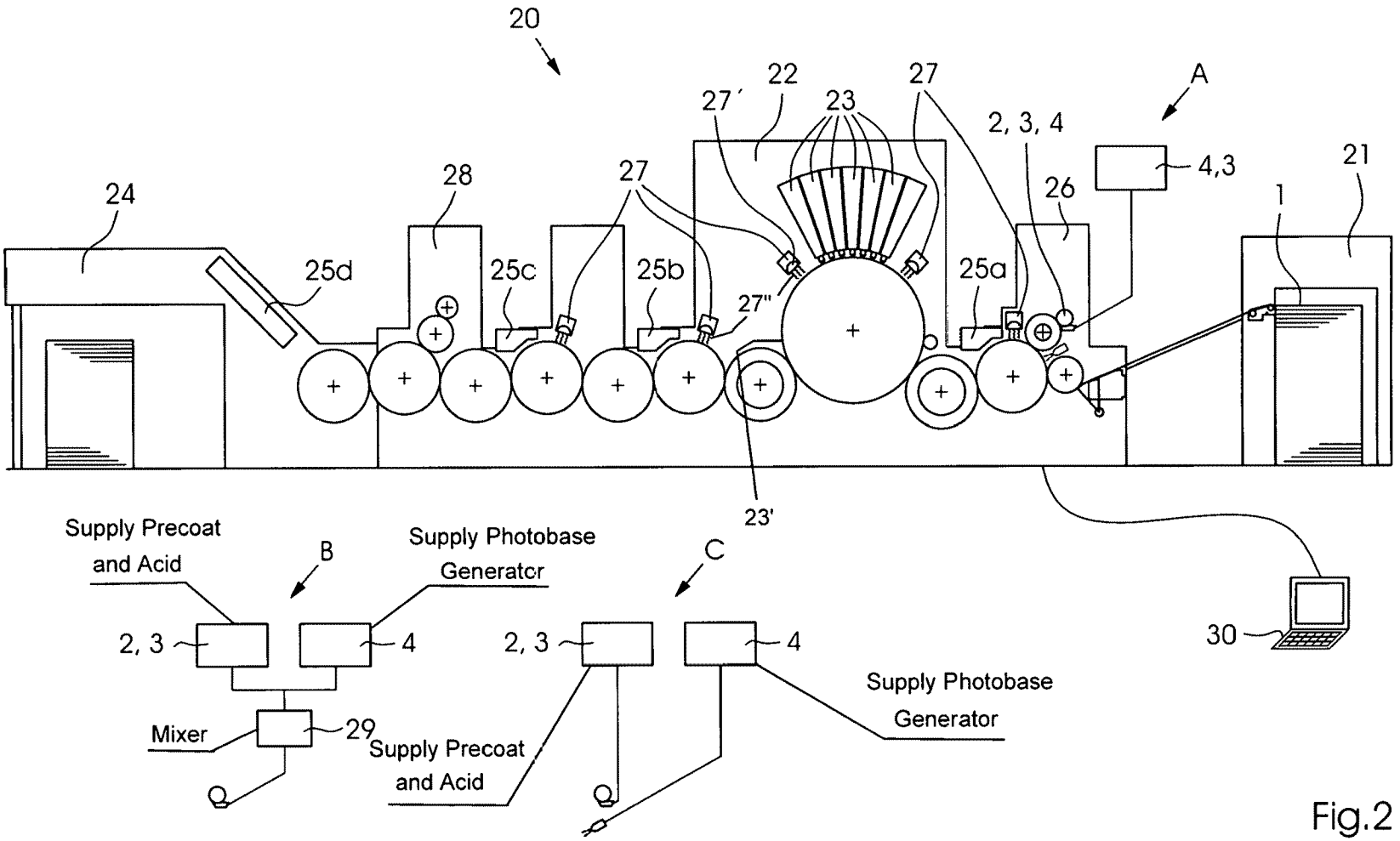
FIG. 2 is a diagrammatic, longitudinal-sectional view of a preferred exemplary embodiment of a printing machine of the invention implementing the method of the invention.

FIG. 2 illustrates a preferred exemplary embodiment of a printing machine 20 of the invention for carrying out the method illustrated in FIG. 1. The machine and thus the method of the invention carried out thereon are controlled by a computer 30 or rather a program running thereon.

The printing machine 20 includes the substrate feeder 21, preferably a sheet feeder 21, the at least one ink print head 23, and the at least one drier 25*a*, 25*b*, 25*c* and/or 25*d*, in particular a thermal drier, e.g. an IR drier and/or a hot-air drier. The print head (preferably seven print heads or print head rows for the colors K, CMY and OGV) may be disposed in a printing unit 22.

The printing machine 20 further includes the application device 26 for the precoat 2, the at least one emitter 27 for generating the base 4' in a photolytic process, and the varnishing unit 28.

The photobase generator 4 may be supplied in accordance with an option A shown in FIG. 2. In accordance with this option, the generator has previously been added to the precoat 2 and applied to the substrate 1 together with the latter. Alternatively (in accordance with an illustrated option B), the generator and the precoat may be mixed in a mixer 29 before being applied to the substrate. In accordance with a further alternative (as illustrated in option C), the generator and the precoat may be separately applied to the substrate, e.g. sprayed on.

FIG. 3 is a diagrammatic view of the printed product 8 that has been created in accordance with the invention, including a precoat 2 applied to a substrate, with the precoat 2 containing an acid 3, as well as image areas 5 and non-image areas 6 located on the substrate. Both image areas and non-image areas have been varnished, i.e. covered with a water-based varnish 7. In the illustrated example, the photobase generator 4 has been applied together with the precoat, i.e. it is present in the same location. Depending on the irradiation, the base 4' is present at least in the non-image areas.

The invention claimed is:

1. A method for producing printed products, the method comprising the following steps:

coating a substrate with a precoat containing at least one acid or supplying a substrate having been coated with a precoat containing at least one acid;

using at least one ink print head to apply a water-based ink to image areas on the coated substrate;

drying at least one of the printed substrate or the ink;

providing a photobase generator in the precoat or applying a photobase generator at least locally to non-image areas on the substrate;

irradiating the substrate at least locally in non-image areas to generate a base; and varnishing the printed substrate with a water-based varnish.

2. The method according to claim 1, which further comprises supplying the precoat already containing the photobase generator or separately supplying and mixing the precoat and the photobase generator.

3. The method according to claim 1, which further comprises selecting the photobase generator from the group of photobase generators consisting of:

quaternary ammonium salts of organic acids or phenylglyoxylic acid, or oxo xanthan propionic acid, or O-acyloximes, amine-substituted ketones or 2-methyl-1-[4-(methylthio) phenyl]-2-(4-morpholinyl)-1-propanone, and quaternary ammonium salts of dithiocarbamate.

4. The method according to claim 1, which further comprises carrying out the irradiation step at least one of:

in an ultraviolet wavelength range, by using at least one LED to create the radiation, or in a wavelength range below 400 nanometers.

5. The method according to claim 1, which further comprises carrying out the irradiation step before or immediately before the ink applying step.

6. The method according to claim 1, which further comprises carrying out the irradiation step before or immediately before the drying step.

7. The method according to claim 1, which further comprises carrying out the irradiation step before or immediately before the varnishing step.

8. The method according to claim 1, which further comprises carrying out the drying step as a thermal process by applying at least one of electromagnetic irradiation or heated air.

9. A printing machine for producing printed products, the printing machine comprising:

a substrate feeder for supplying a substrate;

a precoat application device disposed downstream of said substrate feeder for coating the substrate with a precoat containing at least one acid and for coating the substrate with a photobase generator at least locally in non-image areas of the substrate;

at least one ink print head disposed downstream of said precoat application device for applying a water-based ink to image areas on the coated substrate;

an emitter disposed downstream of said precoat application device for irradiating the substrate at least locally in non-image areas to generate a base;

a drier disposed downstream of said precoat application device or downstream of said emitter for drying at least one of the printed substrate or the ink; and a varnishing unit disposed downstream of said emitter for varnishing the printed substrate with a water-based varnish.

10. A printing machine for producing printed products, the printing machine comprising:

a substrate feeder for supplying a substrate;

at least one application device disposed downstream of said substrate feeder for applying a precoat containing al least one acid and for separately applying a photo-base generator at least locally to non-image areas on the substrate;

at least one ink print head disposed downstream of said at least one application device for applying a water-based ink to image areas on the coated substrate;

an emitter disposed downstream of said at least one application device for irradiating the substrate at least locally in non-image areas to generate a base;

a drier disposed downstream of said at least one application device or downstream of said emitter for drying at least one of the printed substrate or the ink; and a varnishing unit disposed downstream of said emitter for varnishing the printed substrate with a water-based varnish.

* * * * *